United States Patent [19]

Fenner et al.

[11] 4,235,165

[45] Nov. 25, 1980

[54] COMPACTOR FOR WASTE MATERIAL

[75] Inventors: Gordon H. Fenner, Columbus, Miss.; Gary R. Fenner, Tuscaloosa, Ala.

[73] Assignee: Marathon Equipment Company, Inc., Vernon, Ala.

[21] Appl. No.: 68,381

[22] Filed: Aug. 21, 1979

Related U.S. Application Data

[63] Continuation of Ser. No. 924,698, Jul. 14, 1978, abandoned.

[51] Int. Cl.[3] ..... B30B 15/30

[52] U.S. Cl. ..... 100/53; 100/215; 100/229 A; 100/233; 100/295

[58] Field of Search ..... 312/333; 100/53, 215, 100/229 R, 229 A, 233, 295

[56] References Cited

U.S. PATENT DOCUMENTS

| | | | |
|---|---|---|---|
| 1,234,900 | 7/1917 | Hipschen | 312/333 X |
| 2,700,333 | 1/1955 | Polsen | 100/229 R |
| 3,691,944 | 9/1972 | Boyd | 100/229 A |
| 3,717,091 | 2/1973 | Moon | 100/229 A |
| 3,868,903 | 3/1975 | Montalbano | 100/229 A |
| 3,881,407 | 5/1975 | Goar | 100/229 A |

FOREIGN PATENT DOCUMENTS

| | | | |
|---|---|---|---|
| 2425584 | 12/1974 | Fed. Rep. of Germany | 100/229 A |
| 564467 | 7/1975 | Switzerland | 100/229 A |
| 596980 | 3/1978 | Switzerland | 100/229 A |

*Primary Examiner*—Billy J. Wilhite

*Attorney, Agent, or Firm*—Shlesinger, Arkwright, Garvey and Dinsmore

[57] ABSTRACT

A compactor packs waste material in an open top container which is adapted for movement inwardly and outwardly of a supporting frame. A ram unit is pivotally supported at one end by the frame with its other end being movable selectively to an extended position within the container, a retracted position above the container, and an intermediate position at the top of the container. A housing encases the ram unit and has an opening for feeding waste material into the container while the ram unit is in the intermediate position. A power unit is operatively connected to and moves the ram unit selectively to the extended, retracted and intermediate position.

7 Claims, 3 Drawing Figures

COMPACTOR FOR WASTE MATERIAL

This is a continuation, of application Ser. No. 924,698, filed July 14, 1978 now abandoned.

BACKGROUND OF THE INVENTION

This invention relates to a compactor for waste material and more particularly to such a compactor which is adapted to compress waste material into an open top container which is movable selectively into and out of a supporting frame.

Heretofore in the art to which our invention relates, difficulties have been encountered in providing compactors for waste material wherein full security is provided at all times so that waste material may be disposed of through an opening in the wall of a building, such as a store. Also, difficulties have been encountered in providing such a compactor which will permit effective packing of the waste material whereby it is not packed tightly alongside the inner walls of the container whereby the material may be readily discharged from the container. Also, difficulties have been encountered in preventing the packer unit from moving downwardly within the container by its own weight where fluid pressure operated rams have been employed.

Conventional type compactor units are shown in the Goar U.S. Pat. No. 3,881,407; the Montalbano U.S. Pat. No. 3,868,903; the Moon U.S. Pat. No. 3,717,091; and the Boyd U.S. Pat. No. 3,691,944.

SUMMARY OF THE INVENTION

In accordance with our invention, we provide a compactor for waste material wherein an open top container is adapted for movement into and out of a supporting frame. A ram unit pivotally supported at one end by the supporting frame is adapted for movement selectively to an extended packing position within the container, a retracted, loading position in spaced relation above the container, and an intermediate, closing position adjacent the top of the container. The ram unit and the upper end of the container is encased by a housing having a feed opening for introducing waste material into the container while the ram unit is in the retracted, loading position. A power unit is interposed between the ram unit and the supporting frame for moving the ram unit selectively to the extended position, the retracted position and the intermediate position.

It is an object of our invention to provide a compactor for waste material of the character designated which shall provide full security, thus particularly adapting our apparatus for use in disposing of waste material through an opening in the wall of a building, such as a store or the like.

Another object of our invention is to provide a compactor unit in which the ram unit returns to a position just outside the container for the refuse after making each packing stroke to thus exert pressure on the refuse which, along with the weight of the refuse itself, causes the refuse to lose its memory whereby the refuse does not return to its fully expanded position after being compacted.

Another object of our invention is to provide a compactor unit which reduces or eliminates spillage as the container is removed from its supporting frame and also one which eliminates the possibility of leakage between the ram unit and the open top container while in use.

A further object of our invention is to provide a compactor unit which pacts the waste material effectively within the container without packing the material tightly alongside the inner walls of the container whereby the waste material may be unloaded with a minimum of effort. A still further object of our invention is to provide a compactor for waste materials wherein the container for the waste materials may be removed from and replaced in its supporting frame with a conventional front loader unit carried by garbage trucks without the driver having to leave the vehicle.

DESCRIPTION OF THE DRAWINGS

A compactor for waste material embodying features of our invention is illustrated in the accompanying drawings, forming a part of this application, in which.

DETAILED DESCRIPTION

Figure 2:
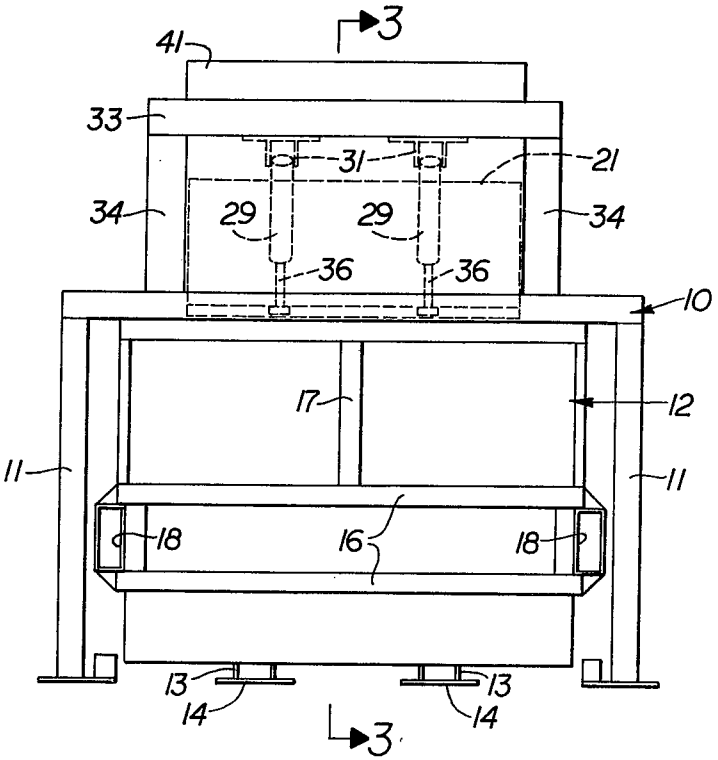
FIG. 2 is an end elevational view taken along the line 2—2 of FIG. 1; and, FIG. 3 is an enlarged, sectional view taken generally along the line 3—3 of FIG. 2.

Referring now to the drawings for a better understanding of our invention, we show a supporting frame 10 having depending legs 11 which are secured to a supporting surface by any suitable means. As shown in FIG. 2, the supporting frame 10 is generally U-shaped to provide an opening for receiving an open top container 12 which receives waste material.

Figure 3:
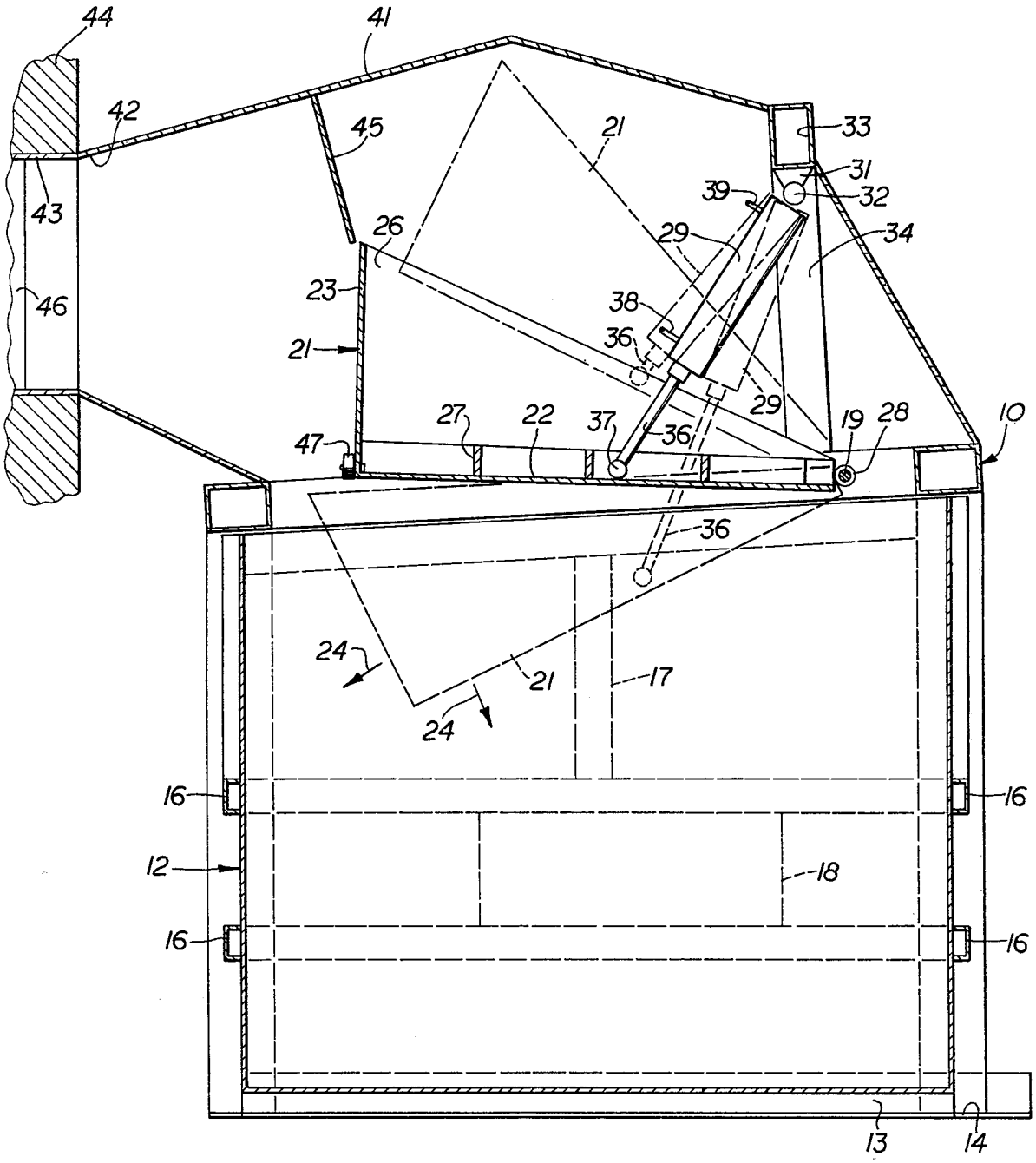

As shown in FIGS. 2 and 3, longitudinally extending, parallel runners 13 are carried by the under surface of the container 12 in position to engage the upper surface of and slide relative to longitudinally extending support plates 14 which are preferably supported at the same level as the lower ends of the legs 11 for the supporting frame 10. The under surface of the runner 13 engages the upper surface of the plate 14 with a friction fit whereby the container 12 does not move relative to the plates 14 until force is applied to remove the container 12. The under surface of the runners 13 and the upper surface of the plates 14 may be roughened or provided with slight deformations or projections therein to restrain free movement of the runners relative to the supporting plates until a force is applied to remove the container 12 from the supporting frame 10.

Figure 1:
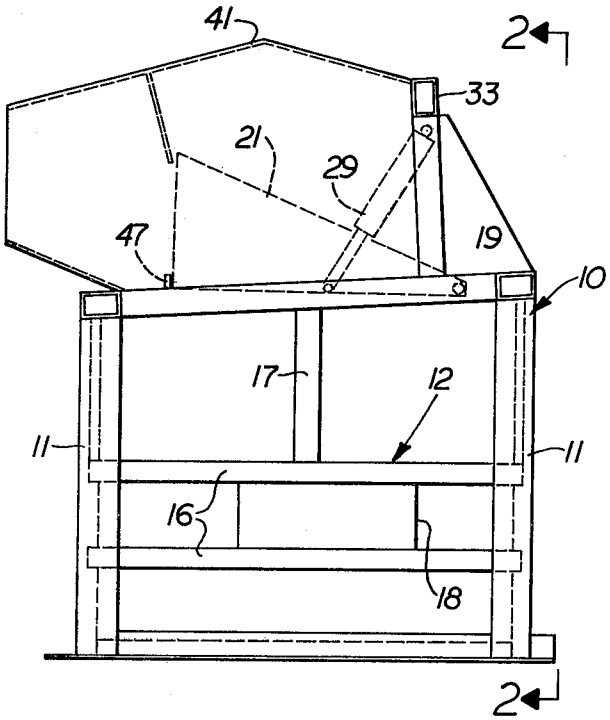
FIG. 1 is a side elevational view showing the container for receiving waste material mounted within its supporting frame with the ram unit being shown in dotted line in its intermediate, closing position.

The container 12 is reinforced by channel-like members 16 which surround the container. Also, suitable vertical braces or frame members 17 may be provided at the sides and ends of the container 12, as shown. To facilitate removal of the container 12 from the supporting frame 10 and insertion of the container 12 into the supporting frame 10, longitudinally extending sleeve-like members 18 are carried by opposite sides of the container 12 between the frame members 16 for receiving the usual lift forks carried by a garbage truck or the like whereby the container 12 may be slightly lifted and then slid outwardly of the supporting frame 10. After dumping the contents of the container 12 into the truck, the container 12 is then reinserted into the supporting frame 10 by aligning the runners 13 with the plates 14 and then moving the container 12 inwardly of the supporting frame 10 to the position shown in the drawings. As shown in FIG. 1 and 3, the upper portion of the supporting frame 10 and the adjacent upper portion of the container 12 slope downwardly and rearwardly to facilitate insertion of the container 12 into and removal from the supporting frame 10.

Pivotally connected to the supporting frame 10 by a pivot shaft 19 is one end of a ram unit 21 having a lower wall 22 which extends in a generally horizontal plane while the ram unit is in its normal or intermediate position. The end of the bottom wall 22 opposite the end thereof connected to the shaft 19 is connected to an upstanding wall 23 so that upon downward pivotal movement of the ram unit 21 the upstanding wall 23 and the lower wall 22 slope downwardly and inwardly of the container toward the point of connection between the lower wall 22 and the upstanding wall 23 to thereby define a wedge-shaped packing surface which is adapted to compact waste material in directions downwardly and outwardly relative to the point of connection between the lower wall 22 and the upstanding wall 23. That is, the waste material is compacted in the direction of the arrows indicated at 24 in FIG. 3. Also, as shown in FIG. 3, the ram unit 21 is provided with side walls 26 and suitable brace members indicated generally at 27. The shaft 19 rotates in suitable bearings 28 which are located at the end of the supporting frame which receives the container 12 as it is inserted therein.

The waste material is introduced into the open top container 12 at the side thereof opposite the side carrying the shaft 19. That is, the waste material is introduced into the container adjacent the end of the ram unit 21 which carries the upstanding wall 23.

As shown in FIG. 3, the ram unit 21 is adapted for movement selectively to an extended packing position within the container 12, a retracted, loading position in spaced relation above the container 12 and an intermediate, closing position adjacent the top of the container. The intermediate, closing position is the normal position of the ram unit, as shown in solid lines in FIG. 3. The lower packing position and the upper loading position are shown in dotted lines in FIG. 3. To move the ram unit 21 selectively to the extended, packing position, retracted loading position and the intermediate, closing position, a fluid pressure operated unit is interposed between the supporting frame 10 and the ram unit 21. The fluid pressure operated unit is shown as being in the form of a pair of hydraulic cylinders 29 which are pivotally connected at their upper ends of clevis-like members 31 by clevis pins 32. The clevis members 31 are secured to a transverse beam 33 which in turn is supported by upstanding frame members 34 that form a part of the supporting frame 10, as shown. The hydraulic cylinders 29 each carry a piston rod 36 which is pivotally connected to the horizontal wall 22 of the ram unit 21 by a suitable pivot pin 37. Fluid under pressure is introduced into and removed from opposite ends of the hydraulic cylinder 29 by conduits 38 and 39 which are operatively connected to a suitable source of fluid under pressure. The position of the piston rods 36 and the ram units 21 connected thereto is controlled by conventional control units which include control valves. In view of the fact that such control units are well known in the art to which our invention relates, no further description thereof is deemed necessary.

Mounted on top of the supporting frame 10 is a housing 41 which encases the ram unit 21 and closes the upper end of the supporting frame 10, as shown. As clearly shown in FIG. 3, the housing 41 is provided with a feed opening 42 which is located adjacent the side of the ram unit 21 which carries the upstanding wall 23. The feed opening 42 is shown as being in alignment with an opening 43 provided in the side of a building 44, such as a store, whereby waste material may be discharged directly from the interior of the store into the feed opening 42 while the ram unit 21 is in the raised or retracted, loading position. A depending deflector plate 45 is secured to the upper wall of the housing 41 with the lower end of the deflector plate extending inwardly to a point adjacent the upper end of the ram unit 21 while the ram unit is in the closing position, as shown in solid lines in FIG. 3. Accordingly, waste materials passing through the opening 42 in the housing 41 are deflected downwardly into the container 12.

As shown in FIGS. 1 and 3, resilient roller-like members 47 are mounted adjacent opposite sides of the ram unit 21 adjacent the point of connection between the bottom wall 22 and the upstanding wall 23 in position to engage an adjacent portion of the supporting frame 10 with a friction fit while the ram unit 21 is in the intermediate, closing position shown in solid lines in FIG. 3. The resilient roller-like members 47 thus retain the ram unit 21 in the intermediate, closing position until sufficient force is exerted by the hydraulic cylinders 29 to distort the resilient roller-like members 47 and thus move the rollers downwardly along with the ram unit 21 into the container. Accordingly, the resilient rollers 47 prevent the ram unit 21 from moving by its own weight from the intermediate closing position shown in solid lines in FIG. 3 to the lower, extended position within the container 12. Accordingly, the packer unit 21 is retained in its normal, closing position at all times except for the time that it is raised to the retracted position to receive waste material through the opening 42 and when it is moved to its extended or lower compacting position within the container 12. With the ram unit 21 in the normal, intermediate position, no one could enter the building 44 through the passageway 43 due to the fact that the ram unit 21, while in the intermediate, closing position, would prevent a person from moving upwardly through the housing 41 and its opening 42 to the opening 43 in building 44, even though the container 12 might be removed from its supporting housing 10. Accordingly, security is provided at all times.

As shown in FIG. 3, the ends of the ram unit 21 are located inwardly of the adjacent portions of the container 12 so that the waste material alongside the adjacent portions of the container 12 is not packed tightly thereagainst to thereby facilitate removal of the waste material from the container after the container is removed from the supporting frame 10.

From the foregoing description, the operation of our improved compactor for waste material will be readily understood. The supporting frame 10 is mounted adjacent a wall 44 of a building with a feed opening 42 of the housing 41 in alignment with the opening 43 through the wall 44 whereby waste material may be disposed of through the opening 43 into the feed opening 42 of the housing 41. The opening 43 in the wall 44 is provided with a door 46 which is opened only when waste material is to be discharged into the compactor. Accordingly, the door 46 may be operatively connected by conventional operating means whereby the ram unit 21 is moved to the retracted, loading position adjacent the upper portion of the housing 41 while the door 46 is opened. Also, if desired, suitable safety control means may be associated with the door 46 so that any time the access door is opened while the ram is moving, movement of the ram will cease instantly in order to avoid a safety hazard. Also, when the door 46 is closed the ram unit 21 would automatically retract to the intermediate position shown in solid lines in FIG. 3 whereby the ram unit would not only close the upper end of the container 12 but would also close the access opening to the container 12. That is, the ram unit 21 would cooperate with the depending deflector plate 45 and the adjacent, upper portion of the supporting frame 10 to seal off the feed passageway into the container 12. In view of the fact that such safety control units operatively connecting the door 46 to the means for actuating the ram unit 21 are conventional and well known components which would suggest themselves to one skilled in the art, no further description thereof is deemed necessary.

With the compactor mounted against the wall 44, as shown in FIG. 3, the container 12 is then in position to receive the waste material upon movement of the ram unit 21 to the raised or retracted position shown in FIG. 1. To compact the material in the container 12, the hydraulic cylinder 29 is actuated in a direction to move the ram unit 21 to the lower, extended position shown in dotted lines in FIG. 3 whereby the waste material is packed in the direction of the arrows 24. Since the ends of the ram unit 21 are spaced from the adjacent ends of the container 12, the material is not packed tightly against the end walls of the container 12 whereby the waste material may be readily removed after the container 12 has been removed from the supporting frame 10. Upon returning the ram unit 21 to the normal, closing position, as shown in solid lines as shown in FIG. 3, the resilient rollers 47 engage the adjacent portion of the supporting frame 10 to thus restrain downward movement of the ram unit 21 until sufficient force is exerted by the hydraulic cylinders 29 to force the ram unit downwardly into the container 12. With the ram unit 21 in the solid line position shown in FIG. 1, the container 12 may be removed from the supporting frame 10 by inserting the lift forks of the garbage truck into the sleeve-like members 18 at each side of the container 12. The container 12 is then lifted slightly and then pulled outwardly of the supporting frame 10.

From the foregoing, it will be seen that we have devised an improved compactor for waste material. By providing means for positively sealing the feed passageway into the compactor, maximum security is provided at all times. That is, the upstanding wall 23 of the ram unit cooperates with the depending plate 45 and the adjacent portion of the supporting frame 10 to prevent anyone from passing through the housing 41 into the building having the wall 44. Also, the resilient roller-like members 47 engage the adjacent portion of the supporting frame 10 to prevent the ram unit 21 from moving by its own weight downwardly into the container 12. Also, by providing the depending plate 45 and the ram unit 21 which is in the uppermost loading position while material is introduced into the compactor, I eliminate leakage of the waste material between the packer and the container while in use. Also, by providing a packer unit which does not pack the waste material tightly against the end walls of the container, the container may be readily emptied after removal from the supporting frame with a minimum of effort. Furthermore, by providing sleeve-like members at each side of the container for receiving the usual lift forks carried by garbage trucks and the like, the driver of the truck may empty the container with his front loader without leaving the cab of the truck.

While we have shown our invention in but one form, it will be obvious to those skilled in the art that it is not so limited, but is susceptible of various changes and modifications without departing from the spirit thereof.

What we claim is:

1. A compactor for waste material comprising:

(a) a supporting frame (b) an open top container for receiving waste material to be compacted and adapted for movement selectively to a first position within said supporting frame and to a second position outwardly of said supporting frame (c) a ram unit pivotally supported at one end by said supporting frame with the other end thereof being movable selectively to an extended packing position within said container, a retracted loading position in spaced relation above said container and an intermediate closing position adjacent the top of said container (d) a housing encasing said ram unit and having a feed opening adjacent said other end of said ram unit for introducing waste material into said container while said ram unit is in said retracted loading position (e) a power unit operatively connected to said ram unit for moving said ram unit selectively to said extended packing position, said retracted loading position and said intermediate closing position, and (f) at least one resilient roller-like member carried by said ram unit in position to engage the adjacent portion of said supporting frame with a friction fit while said ram unit is in said intermediate closing position to retain said ram unit in said intermediate closing position until sufficient force is exerted by said power unit to distort said resilient roller-like member and move the same downwardly along with said ram unit into said container.

2. A compactor for waste material comprising:

(a) a stationary supporting frame mounted on a supporting surface (b) the upper limit of said supporting frame being sloped downwardly and rearwardly (c) an open top trash container removably positioned on the supporting surface within said supporting frame, the upper limit of said trash container sloping downwardly and rearwardly at substantially the same angle as the sloping upper limit of said supporting frame whereby, when the trash container is fully inserted into the supporting frame, the upper limit of said trash container lies in close proximity to the adjacent portion of the supporting frame (d) a housing mounted on top of, and enclosing the top of said frame, said housing having top, side and end walls (e) a feed opening in one of said end walls through which trash is inserted into the compactor (f) a ram unit including a lower wall which extends in a generally horizontal plane across the top opening of the trash container while the ram unit is in an intermediate position (g) means for pivotally connecting one end of the lower wall to the upper end of said supporting frame near the front thereof (h) said ram unit further including a cylinder and piston, said piston being engaged with said lower wall at an intermediate point thereof, and (i) power means for extending said piston outwardly from said cylinder to move said lower wall downwardly and inwardly about its pivotal engagement with said supporting frame into a packing position, and retracting the same to a raised position, to permit trash to be inserted through the feed opening into the open top container.

3. The compactor of claim 2, with the addition of (a) an upstanding wall connected to said lower wall adjacent the end thereof opposite the end pivotally connected to said supporting frame whereby, upon actuation of said ram unit, said upstanding wall and lower wall move downwardly and inwardly of the trash container to compact waste in directions downwardly and outwardly relative to the point of connection between the upstanding wall and lower wall.

4. The compactor of claim 3, with the addition of (a) parallel runners secured to the under surface of said trash container for sliding engagement with the supporting surface when the trash container is inserted into, and removed from, said supporting frame.

5. A compactor for waste material comprising (a) a stationary supporting frame mounted on a supporting surface (b) said stationary supporting frame including a pair of spaced front legs and a pair of spaced rear legs (c) said rear legs being shorter than said front legs (d) said supporting frame further including substantially horizontal members connecting the upper ends of said front legs and the upper ends of said rear legs (e) members connecting the upper ends of said front legs to said rear legs, the connecting members being disposed at an angle to the horizontal, whereby the upper limit of said supporting frame slopes downwardly and rearwardly (f) an open top trash container removably positioned on the supporting surface within said supporting frame, the upper limit of said trash container sloping downwardly and rearwardly at substantially the same angle as the sloping upper limit of said supporting frame whereby, when the trash container is fully inserted into the supporting frame, the upper limit of said trash container lies in close proximity to the adjacent portion of the supporting frame (g) a housing mounted on top of, and enclosing, the top of said supporting frame (h) said housing having top, side and front and rear end walls (i) a feed opening in said rear end wall through which trash is fed into the compactor (j) a ram unit including cylinder and piston means (k) means for supporting said cylinder adjacent said front end wall of said housing (l) said ram unit further including a movable lower wall which extends in a generally horizontal plane across the top opening of the container while the ram unit is in an intermediate position (m) means for pivotally connecting one end of said movable lower wall to the upper end of said supporting frame near the front of the compactor (n) means for connecting said piston means to said lower end wall, and (o) power means for extending said piston rod means outwardly from said cylinder means to lower said movable lower wall into a packing position, and retracting the same to a raised position, to permit trash to be inserted through the feed opening into the open top container.

6. The compactor of claim 5, with the addition of (a) tubular sleeves secured to opposite sides of said open top container adapted for engagement by external lifting means which slide said open top container from said supporting frame.

7. The compactor of claim 6, with the addition of (a) parallel runners secured to the under surface of said trash container for sliding engagement with the supporting surface, when the trash container is inserted into, and removed from, said supporting frame.

* * * * *